US007010999B1

(12) United States Patent
Wu

(10) Patent No.: US 7,010,999 B1
(45) Date of Patent: Mar. 14, 2006

(54) BI-DIRECTIONAL ADJUSTABLE SPANNER WITH A DRIVING ROLLER

(75) Inventor: Arthur Wu, Taichung Hsien (TW)

(73) Assignee: Proxent Tools Co., LTD, Taichung (TW)

( * ) Notice: Subject to any disclaimer, the term of this patent is extended or adjusted under 35 U.S.C. 154(b) by 0 days.

(21) Appl. No.: 11/124,956

(22) Filed: May 10, 2005

(51) Int. Cl.
*B25B 13/16* (2006.01)

(52) U.S. Cl. ..... 81/170; 81/155; 81/164; 81/165; 81/172; 81/179; 81/185.2

(58) Field of Classification Search ..... 81/164, 81/165, 155, 170, 172, 179, 185.2
See application file for complete search history.

(56) References Cited

U.S. PATENT DOCUMENTS 6,079,300 A * 6/2000 Hu ..... 81/165
6,739,223 B1 * 5/2004 Wu ..... 81/179

* cited by examiner

*Primary Examiner*—Lee D. Wilson
*Assistant Examiner*—Shantese McDonald

(57) ABSTRACT

A bi-directional adjustable spanner with a driving roller comprises a head and a handle. The head includes a movable jaw slidably received within a sliding groove of the head; an adjustable sliding rod; a retaining jaw and a driving roller. The retaining jaw haS a receiving chamber; one side of the receiving chamber having an opening facing the movable jaw. The receiving chamber has a straight receiving groove with a U shape end; the receiving chamber being communicated to the straight receiving groove. The driving roller is received in the receiving chamber of the retaining jaw; and a part of the driving roller protruding out of the opening of the receiving chamber towards the movable jaw. An elastomer is received within the receiving groove. A resisting pin of the elastomer resists against the driving roller. A cover sheet is screwed to the opening of the retaining jaw by a screw.

10 Claims, 6 Drawing Sheets

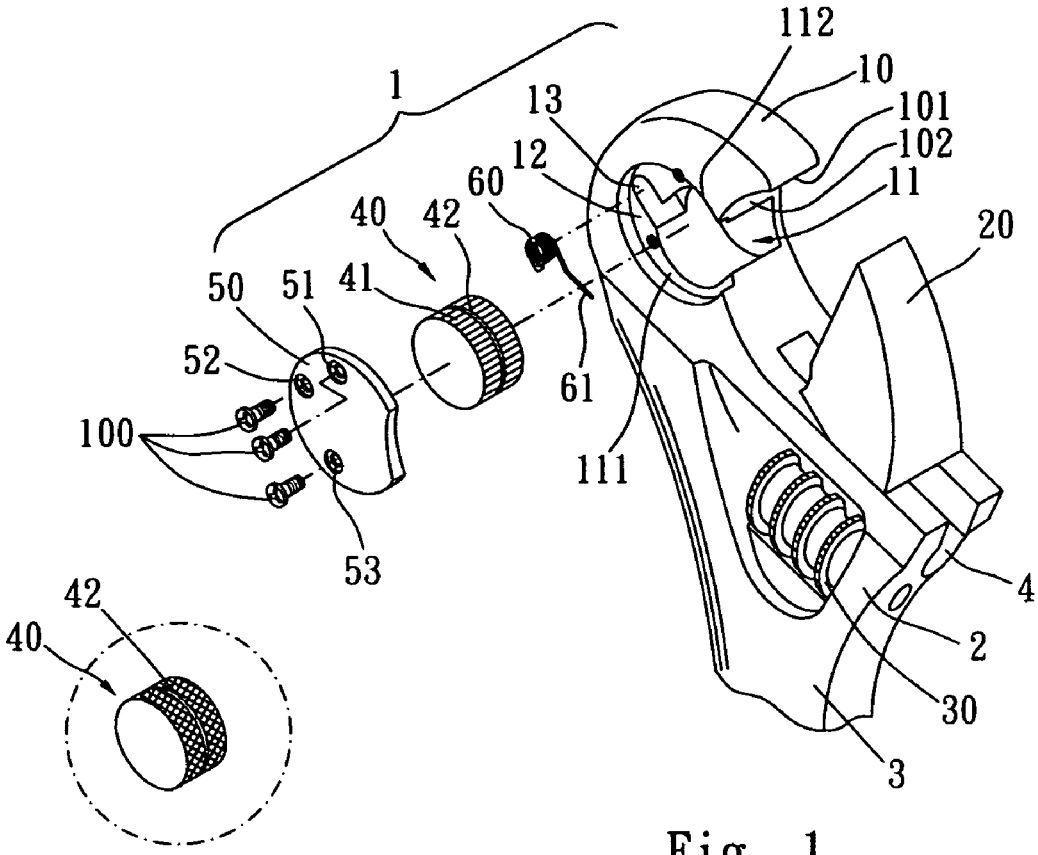
Fig. 1
Fig. 1-1
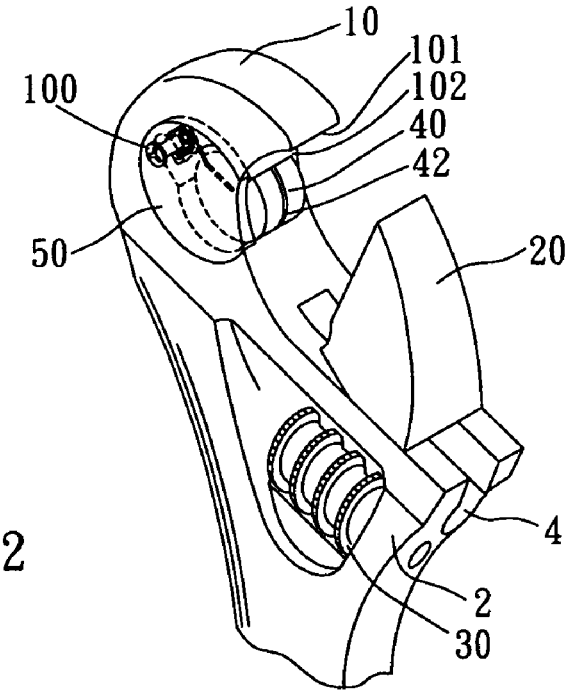
Fig. 2

BI-DIRECTIONAL ADJUSTABLE SPANNER WITH A DRIVING ROLLER

FIELD OF THE INVENTION

The present invention relates to adjustable spanners, and in particular to a bi-directional adjustable spanner with a driving roller, which can drive a nut or stud to rotate reversily.

BACKGROUND OF THE INVENTION

In the prior art adjustable spanner, when a nut has rotated through a predetermined angle, the adjustable spanner must leave from the nut and returns to the original position for further driving the nut. Furthermore, the operation is performed repeatedly so as to achieve the object of screwing or releasing the nut.

In one prior art, a retaining jaw of the adjustable spanner is a receiving chamber having an opening. A driving roller with two posts at two ends is received within the receiving chamber. Two cover sheets cover the two end surfaces of the retaining jaw. The two posts are resisted by a torsional spring in the retaining jaw. Normally, the driving roller protrudes from the receiving chamber. When the adjustable spanner rotates a nut (stud) and the driving roller suffers from an external force, the driving roller moves along a cambered sliding track formed by the two covers, and moves inwards along the track. Thereby the adjustable spanner rotates reversely without leaving from the nut and then drives the nut (or stud).

Above mentioned structure can lock or release a nut or a stud easily and quickly. However, the prior art has the following disadvantages. Firstly, it has the complicated structure. The two surfaces of the retaining jaw must be cut to form a receiving chamber with three open ends. Furthermore, the track is formed by the two covers for confining the two posts. The covers must be formed with sector slots so that when the driving roller moves inwards, the elastomer can be adhered in the sector slot so that the elastomer can effectively resist against the driving roller. Thereby the structure is complicated.

It is difficult in the manufacturing process because to form the sector slot is time tedious and needs much works. Thereby the cost is increased for forming the sector slots.

The structure of the prior art is weaker. The receiving chamber has three open ends so that the structure is weaker. This will cause that the retaining jaw will be destroyed due to the force from the nut.

In another prior art structure, an L shape slot is used to replace the sector slot. However this makes the manufacturing process being tedious and complicated.

Furthermore, the when one end of the nut presses the driving roller to move inwards so that the space becomes larger and thus the spanner can rotate around the nut, but the inner side of the movable jaw has a flat surface. No space can receive the apex of the nut as the nut rotates so that the reverse rotation of the nut cannot be performed smoothly. Moreover in some prior arts, lateral sides of the retaining jaw and movable jaw for clamping a nut have respective flat surfaces. This will cause that the nut cannot rotate reversely.

Further, the opening of the receiving chamber causes dust to flow into the receiving chamber. As a result, the driving roller cannot move with a sufficient distance so that the function of driving a nut to rotate reversely is lost.

SUMMARY OF THE INVENTION

Accordingly, the primary object of the present invention is to provide a bi-directional adjustable spanner with a driving roller, where A bi-directional adjustable spanner with a driving roller comprising: a head and a handle; the head including: a movable jaw slidably received within a sliding groove of the head; an adjustable sliding rod for driving the movable jaw; a retaining jaw; one side of the retaining jaw being sealed and another side of the retaining jaw having a receiving chamber; one side of the receiving chamber having an opening facing the movable jaw; at least one guide track being formed in the receiving chamber; a stopper extending from the guide track near an upper side of the opening of the receiving chamber; the receiving chamber having a straight receiving groove with a U shape end; the receiving chamber being communicated to the straight receiving groove; a driving roller received in the receiving chamber of the retaining jaw; and a part of the driving roller protruding out of the opening of the receiving chamber towards the movable jaw; an elastomer received within the receiving groove; a resisting pin of the elastomer resisting against the driving roller for providing the driving roller having a resisting elastic force toward the opening of the receiving chamber; and a cover sheet having a configuration corresponding to the receiving chamber; the cover sheet being screwed to the opening of the retaining jaw by a screw.

The various objects and advantages of the present invention will be more readily understood from the following detailed description when read in conjunction with the appended drawing.

BRIEF DESCRIPTION OF THE DRAWINGS

FIG. 1 is an exploded schematic view about the bi-directional adjustable spanner with a driving roller of the present invention.

FIG. 1-1 is a schematic view about another embodiment of the driving roller of the present invention.

FIGS. 2 and 3 are operational schematic view about the different views of the driving roller of the present invention.

FIGS. 5-1 to 5-3 show the operation of the present invention, wherein the adjustable spanner rotates counter-clockwise.

FIGS. 6-1 to 6-3 is a partial schematic view about the bi-directional adjustable spanner with a driving roller of the present invention.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figures 1, 2, 3, 5:
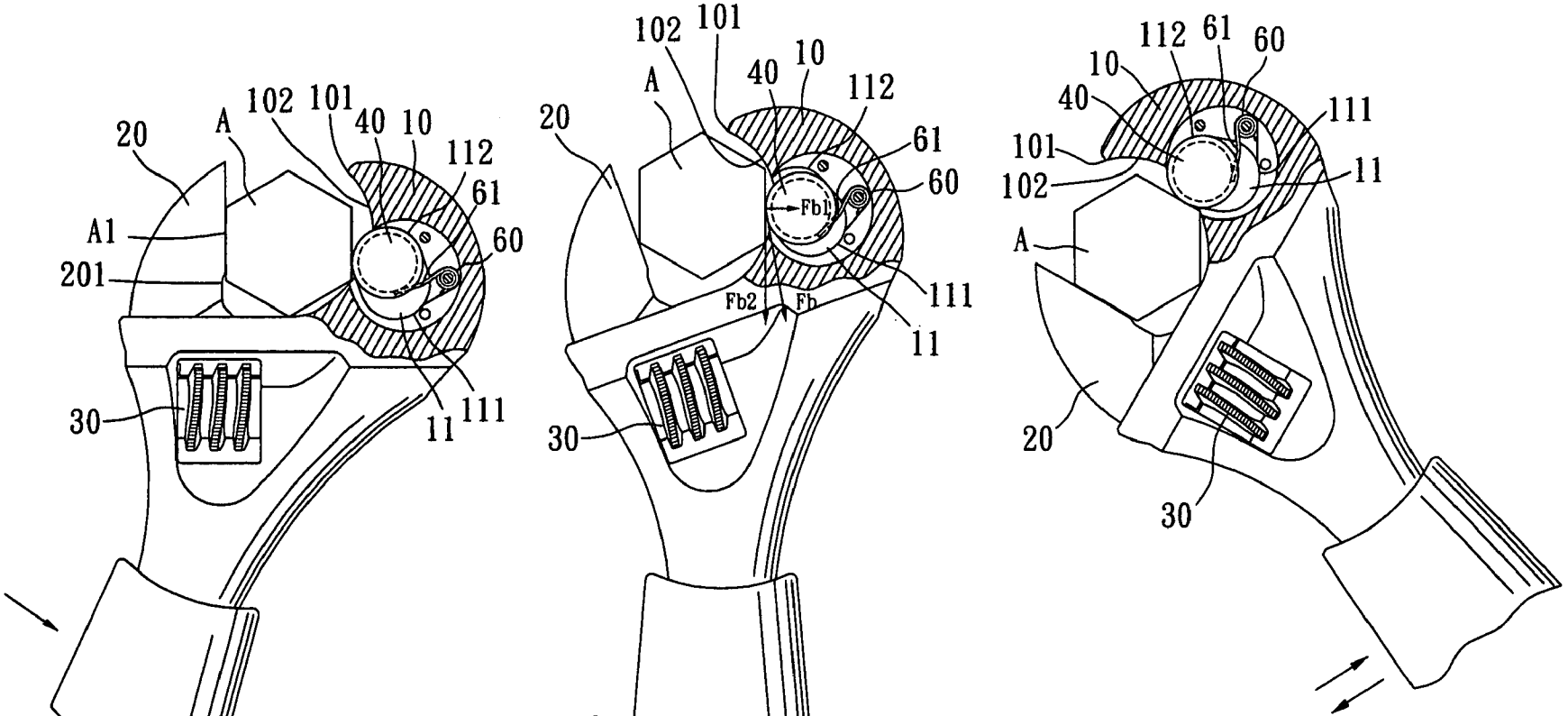

Referring to FIG. 1, the adjustable spanner of the present invention is illustrated. The adjustable spanner 1 has a head 2 and a handle 3. One end of the head 2 is formed with a retaining jaw 10. The retaining jaw 10 has a screw rod 30 at a connection of the head 2 and the handle 3 so that the retaining jaw 10 is moved transversally so as to control the gap of a head 2 and the handle 3. An upper section and a lower section of the inner side of the movable jaw 20 are formed with respective clamping surfaces. The clamping surfaces of the upper and lower sections of the movable jaw 20 are stepped. The connection of the upper and lower sections has a recess 201.

Besides one inner side of the retaining jaw 10 is formed a C shape receiving chamber 11 with a narrow opening and a stepped edge 12. The receiving chamber 11 serves to receive a driving roller 40 and the stepped edge 12 is covered by a cover sheet 50 so as to form a receiving chamber 11 with only one opening.

A lateral wall of an inner side of the receiving chamber 11 is formed with a continuous smooth cambered surface so as to define a guide track 111 and a stopper 112. The guide track 111 has a receiving groove 13 which is communicated to the receiving chamber 11. The receiving groove 13 has a straight shape with a U shape bottom for receiving an elastomer 60.

The driving roller 40 is a round block. The lateral side of the driving roller 40 is formed with a smooth surface as shown in FIG. 2, or is formed with straight textures as shown in FIG. 1, or is formed with a friction portion with intersected lines as shown in FIG. 1-1 for increasing the friction force connected the driving roller 40 and a nut so as to form the nut to slide in the screwing operation of the spanner. Besides a center of the lateral side of the driving roller 40 is formed with an annular trench 42 for resisting the resisting leg 61 of the elastomer 60.

The cover sheet 50 has a shape corresponding to an appearance of the C shape receiving chamber 11. A thickness of the cover sheet 50 is identical to the depth between one end surface of the retaining jaw 10 and the stepped edge 12 so that when the cover sheet 50 coves upon the receiving chamber 11. Other than sealing on open end of the receiving chamber 11, one outer surface of the cover sheet 50 is flushed with the end surface of the retaining jaw 10.

Besides to make the cover sheet 50 steadily combine to the retaining jaw 10, in the present invention, the cover sheet 50 has three screw holes 51, 52, and 53. Two screw holes 51, 52 are corresponding to the screw hole 121 of the stepped edge 12. The middle screw hole 53 of the cover sheet 50 is corresponding to the screw hole 121 of the receiving groove 13. Screws 100 pass through the screw holes of the cover sheet 50 and then pass through the elastomer 60 in the receiving groove 13 so that the elastomer 60 is steadily secured within the receiving groove 13. The screw 100 passing through the elastomer 60 can be used as a supporting axial center so as to provide the resisting legs 61 of the elastomer 60 with a larger resisting force to the driving roller 40.

Referring to FIG. 2, the adjustable spanner of the present invention has a simple structure so that the assembly efficiency can be improved. In practical assembly, an elastomer 60 is placed in the receiving groove 13. The resisting leg 61 of the elastomer 60 will protrude in the receiving chamber 11. Then the driving roller 40 slides into the receiving chamber 11 from the guide track 111. In the sliding process, the resisting leg 61 falls into the annular trench 42 of the driving roller 40 so that a part of the driving roller 40 protrudes out of the receiving chamber 11. Then three screws 100 pass through the screw holes 51, 52, and 53 of the cover sheet 50 and then are screwed into the screw hole 121 of the stepped edge 12. Furthermore, the roll type reversible adjustable spanner of the present invention is assembled.

Figure 4:
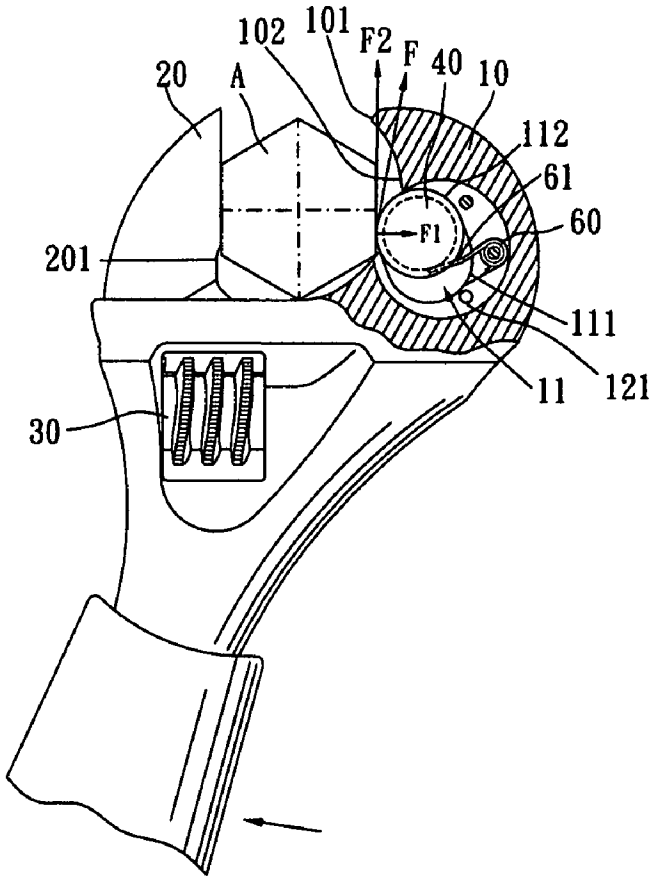
FIG. 4 shows the operation of the present invention, wherein the adjustable spanner rotates clockwise.

In use of the present invention, referring to FIG. 4, when the adjustable spanner 1 clamps a nut A to rotate clockwise, the driving roller 40 will suffer from a resisting force F from the nut A. The resisting force F can be divided into two components F1 and F2. The component F1 will be cancelled due to the stopper 112 of the retaining jaw 10. The force component F2 will generate a torque so that the driving roller 40 rolls toward the driving roller 40. However it will be cancelled by the stopper 112. Therefore when the adjustable spanner 1 rotates clockwise, the nut A is locked tightly, and the driving roller 40 is fixed motionlessly.

Referring to FIGS. 5-1, when the adjustable spanner 1 rotates counterclockwise, the driving roller 40 will suffer from a resisting force F from the nut A. When the resisting force F is divided into components Fb1 and Fb2, the component Fb1 will cause the driving roller 40 to move toward an inner end of the retaining jaw 10 along the guide track 111. The component Fb2 will generate a torque so that the driving roller 40 rolls within the retaining jaw 10 along the guide track 111. Then, the adjustable spanner 1 of the present invention can rotate reversily without driving the nut A.

Figure 3:
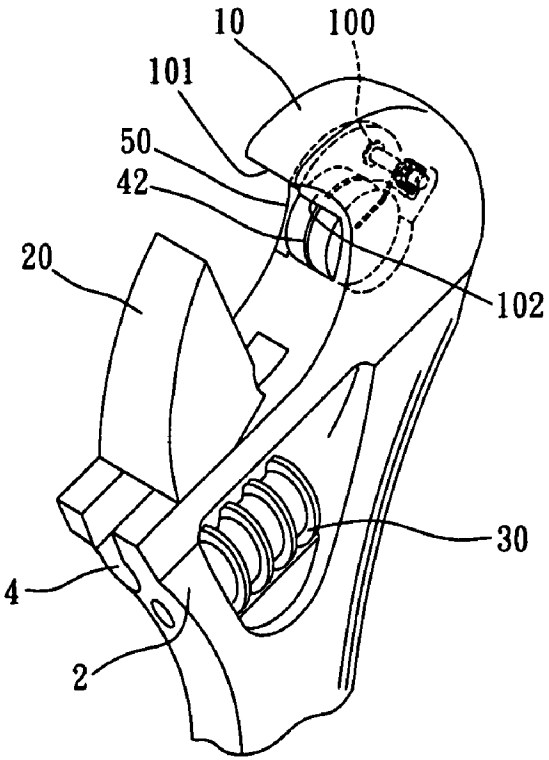

Referring to FIGS. 5-2 and 5-3, when the adjustable spanner 1 rotates reversily to a predetermined angle, as shown in FIGS. 5-3, the driving roller 40 will return to the original position automatically. Then it can rotate clockwise to tighten the nut A. Thereby under the condition of without releasing the nut A, the nut A can be rotate repeatedly.

Figures 1, 6:
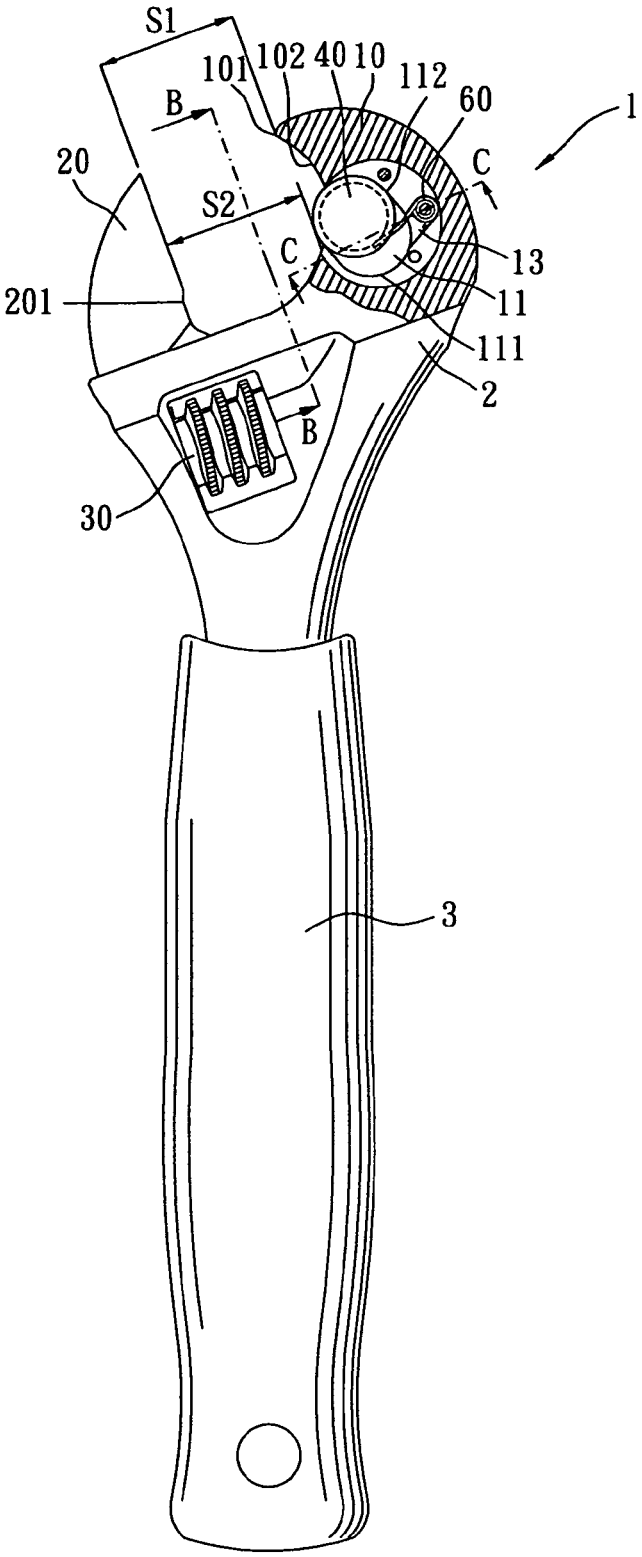
Figures 2, 6:
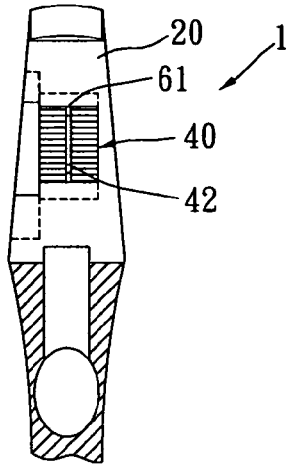
Figures 3, 6:
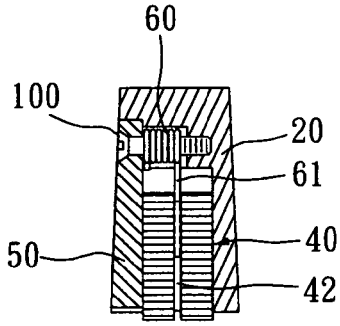

However in above mention structure to screw the nut repeatedly without falling out, it is known in the prior art, the main feature of the present invention is to provide a simplifying structure to the interior of the retaining jaw. Referring to FIG. 6, in the present invention, the driving roller 40 is resisted by the resisting leg 61 of the elastomer 60 in the receiving groove 13. It can find from FIG. 6, the receiving groove 13 receiving the elastomer 60 is different from the prior art L shape groove. The receiving groove 13 of the present invention has a straight shape. Furthermore, the receiving groove 13 is communicated to the receiving chamber 11 so that the receiving groove 13 can be formed by a single process.

The simple straight structure of the receiving groove 13 of the present invention causes the assembly process to be easy with a lower cause without using a torsion spring with two resisting elastomers. Thereby it is better than the prior art.

Furthermore, the straight structure of the receiving groove 13 has less destroy to the retaining jaw 10. Thereby it can improve the structure strength of the retaining jaw 10.

Besides the receiving chamber 11 and straight receiving groove 13 do not penetrate through the retaining jaw 10 so that the retaining jaw 10 has a stronger structure. Furthermore, the retaining jaw 10 has a single opening. Only one cover sheet 50 is sufficient in assembly. Thereby the present invention can be assembled quickly.

A further feature of the present invention is that an interior of the movable jaw 20 has a stepped surface. A recess 201 is formed between the connection of two stepped surfaces. The effect will be illustrated with referring to FIGS. 7 and 8.

Figure 7:
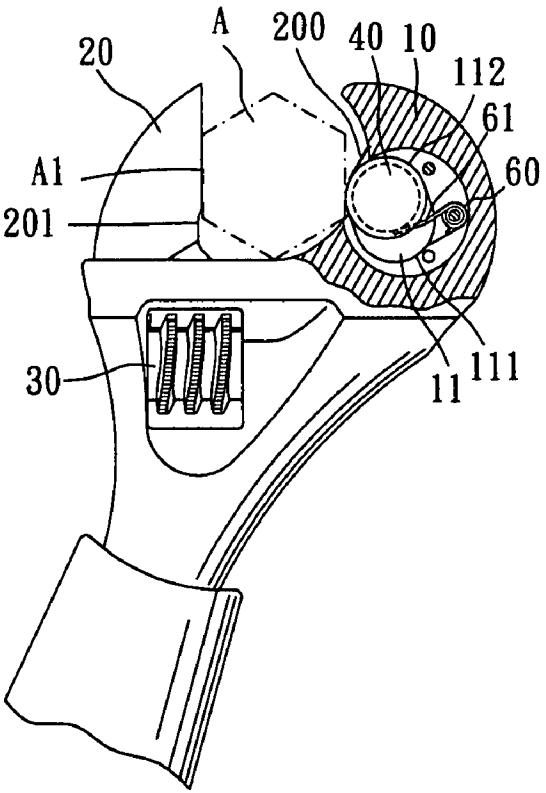
FIG. 7 is a schematic view showing that the adjustable spanner of the present invention clamps a nut.
Figure 10:
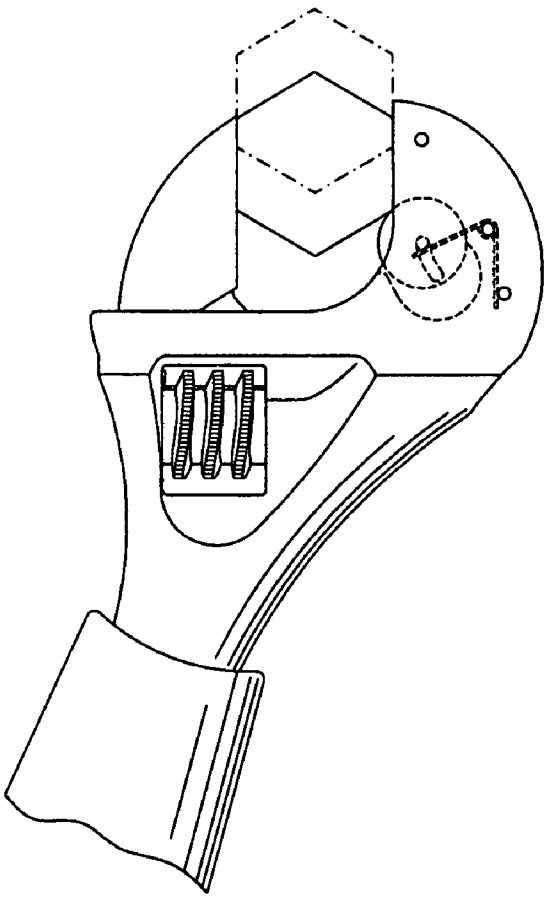
FIG. 10 shows the operation of a prior art bi-directional adjustable spanner with a driving roller.
Figure 9:
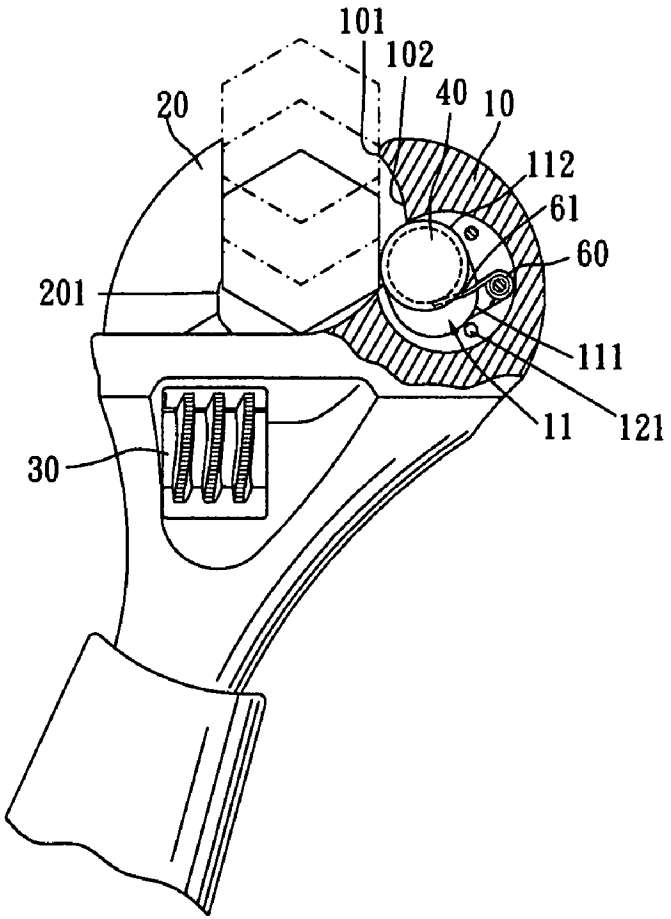
FIG. 9 is a schematic view showing a correct clamping about the clamping of a nut by the adjustable spanner of the present invention.

Referring to FIG. 7, when a nut A is placed between two jaws, one surface A1 of the nut A is adhered to the movable jaw 20. A lower edge A2 of the surface is not in contact to the recess 201. In the driving process, by the recess 201, the edge A2 of the nut A can suffer from a larger torque to have a strong structure.

The maximum effect of the recess 201 is that when the nut A is driven to rotate counterclockwise, the nut A has a larger moving space so that the operation can be performed easily and smoothly.

Figure 8:
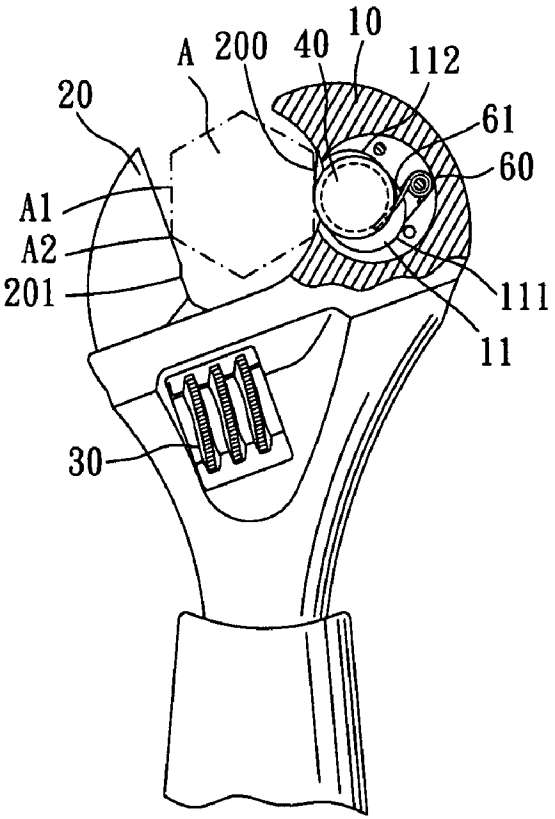
FIG. 8 is a schematic view showing the rotation of the nut by using the bi-directional adjustable spanner with a driving roller of the present invention.

Referring to FIGS. 7 and 8, in the present invention, to prevent the dust from entering into the receiving chamber 11 from the opening due to the inward movement of the driving roller 40 an elastic dust-proof cover 200 is installed at the lower end of the opening of the retaining jaw 10. The elasticity of the elastic dust-proof cover 200 is slightly smaller than the ejecting force of the driving roller 40. Normally, when the nut A rotates reversely so that the driving roller 40 moves inwards, the elastic dust-proof cover 200 is not resisted against the driving roller 40. By the restoring force thereof, the elastic dust-proof cover 200 will cover the opening. Thereby no dust enters into the receiving chamber 11.

Finally, referring to FIGS. 6-1, an upper side 101 of the opening of the retaining jaw 10 facing toward the movable jaw 20 has a concave cambered surface 102. A distance between the upper side 101 and the clamping surface of the movable jaw 20 is S1. A surface of the driving roller 40 facing toward the retaining jaw 10 as the driving roller 40 is at the outermost position of the receiving chamber 11 has a distance S2 with the clamping surface of the movable jaw 20. The S1 is slightly smaller than or equal to the S2.

In use, the spanner of the present invention clamps the nut A which is resisted at the lower apex and the head portion so that it can be driven easily.

In the present invention, the distance between the upper side 101 and the clamping surface of the movable jaw 20 is S1. The surface of the driving roller 40 facing toward the retaining jaw 10 as the driving roller 40 is at the outermost position of the receiving chamber 11 has a distance S2 with the clamping surface of the movable jaw 20. The S1 is slightly smaller than or equal to the S2. Thereby the operation fault can be avoided.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A bi-directional adjustable spanner with a driving roller comprising:

a head and a handle; the head including:

a movable jaw slidably received within a sliding groove of the head;

an adjustable sliding rod for driving the movable jaw;

a retaining jaw; one side of the retaining jaw being sealed and another side of the retaining jaw having a receiving chamber; one side of the receiving chamber having an opening facing the movable jaw; at least one guide track being formed in the receiving chamber;

a stopper extending from the guide track near an upper side of the opening of the receiving chamber; the receiving chamber having a straight receiving groove with a U shape end; the receiving chamber being communicated to the straight receiving groove;

a driving roller received in the receiving chamber of the retaining jaw; and a part of the driving roller protruding out of the opening of the receiving chamber towards the movable jaw;

an elastomer received within the receiving groove; a resisting pin of the elastomer resisting against the driving roller for providing the driving roller having a resisting elastic force toward the opening of the receiving chamber; and a cover sheet having a configuration corresponding to the receiving chamber; the cover sheet being screwed to the opening of the retaining jaw by a screw.

2. The bi-directional adjustable spanner with a driving roller as claimed in claim 1, wherein the opening of the receiving chamber is smaller than a size of the driving roller for confining the driving roller within the receiving chamber.

3. The bi-directional adjustable spanner with a driving roller as claimed in claim 1, wherein the annular trench with a predetermined depth is formed at a middle portion of an annular lateral side.

4. The bi-directional adjustable spanner with a driving roller as claimed in claim 1, wherein line textures are formed at an annular lateral side of the driving roller as a friction portion.

5. The bi-directional adjustable spanner with a driving roller as claimed in claim 1, wherein intersection lines are formed at an annular lateral side of the driving roller as a friction portion.

6. The bi-directional adjustable spanner with a driving roller as claimed in claim 1, wherein the adjustable spanner has a stepped portion, a recess is formed in the stepped portion.

7. The bi-directional adjustable spanner with a driving roller as claimed in claim 1, wherein an upper side of the opening of the retaining jaw facing toward the movable jaw has a concave cambered surface.

8. The bi-directional adjustable spanner with a driving roller as claimed in claim 7, wherein a dust-proof cover is installed upon the concave cambered surface.

9. The bi-directional adjustable spanner with a driving roller as claimed in claim 1, wherein a distance between the upper side and the clamping surface of the movable jaw is S1; a surface of the driving roller facing toward the retaining jaw as the driving roller is at the outermost position of the receiving chamber has a distance S2 with the clamping surface of the movable jaw; the S1 is smaller than the S2.

10. The bi-directional adjustable spanner with a driving roller as claimed in claim 1, wherein a distance between the upper side and the clamping surface of the movable jaw is S1; a surface of the driving roller facing toward the retaining jaw as the driving roller is at the outermost position of the receiving chamber has a distance S2 with the clamping surface of the movable jaw; the S1 is equal to the S2.

* * * * *